United States Patent [19]

Trask

[11] 4,266,405

[45] May 12, 1981

[54] HEAT PUMP REFRIGERANT CIRCUIT

[76] Inventor: Allen Trask, 288 Genesee St., Utica, N.Y. 13502

[21] Appl. No.: 46,006

[22] Filed: Jun. 6, 1979

[51] Int. Cl.[3] ..... F25B 13/00

[52] U.S. Cl. ..... 62/160; 62/503; 62/324.4; 62/324.1

[58] Field of Search ..... 62/324 E, 324 R, 160, 62/503, 81, 278

[56] References Cited

U.S. PATENT DOCUMENTS

| | | | |
|---|---|---|---|
| 2,977,773 | 4/1961 | DeKanter | 62/324 E |
| 3,128,607 | 4/1964 | Kyle | 62/503 X |
| 3,232,073 | 2/1966 | Jobes et al. | 62/503 X |
| 3,246,482 | 4/1966 | Harnish | 62/503 |
| 4,017,286 | 4/1977 | English et al. | 62/324 R |
| 4,045,977 | 9/1977 | Oliver, Jr. | 62/324 E |

*Primary Examiner*—Lloyd L. King
*Attorney, Agent, or Firm*—Charles S. McGuire

[57] ABSTRACT

This invention reduces the time length of defrost cycles in contemporary air-to-air heat pumps by a revision of the system refrigerant circuit wherein two parallel refrigerant circuits connect the reversing valve to the outdoor coil. One circuit includes a trap type accumulator with a check valve in its outlet conduit providing single direction refrigerant flow therethrough only during heating cycles, and the second circuit includes a check valve for single direction refrigerant flow from the reversing valve directly to the outdoor coil bypassing the cold accumulator during defrost cycles to prevent its interception of hot gas from the indoor coil required for quick defrosting of the outdoor coil.

9 Claims, 8 Drawing Figures

HEAT PUMP REFRIGERANT CIRCUIT

BACKGROUND OF THE INVENTION

Contemporary heat pumps include a refrigeration circuit with a compressor and outdoor and indoor heat exchanger coils controlled to function alternately as an evaporator and a condenser in response to a thermostat controlled reversing valve calling for refrigerant flow direction for either heating or cooling cycles. During cooling cycles the indoor coil functions as an evaporator absorbing surplus heat from the indoor air, and the outdoor coil functions as a condenser rejecting that heat into the outdoor air.

During heating cycles the outdoor coil functions as an evaporator absorbing heat from the outdoor air, and the indoor coil functions as a condenser rejecting that heat to the indoor air for comfort heating. During the time outdoor temperatures are around 40 degrees, and colder, moisture from the outdoor air is collected onto the outdoor coil fins in the form of frost. The frost accumulates progressively in thickness on the fin surfaces thereby reducing heat transfer by blocking air flow therethrough, and by its insulating effect on the fin surfaces.

The frost accumulation is periodically removed by temporarily operating the heat pump in a cooling cycle wherein hot refrigerant vapor from the indoor coil is pumped through the compressor to the outdoor coil to heat it for frost removal. A defrost cycle is functionally a temporary cooling cycle. It is common practice to initiate defrost cycles by automatic means responsive to the thickness of frost accumulation, or by an interval timer, and to terminate the cycles by a thermostat sensing temperature rise of the coil, or its condensate, indicating completion of frost removal.

Each heat pump coil is usually provided with its own expansion device operative during the time the coil is serving as an evaporator. The device serving the outdoor coil in heating cycles provides for metering liquid refrigerant to efficiently meet the circumstances of evaporation during a range of cold outdoor winter temperatures. For example, at a winter ambient of 25° F. the evaporating pressure in the outdoor coil would be approximately 35 psi, and the condensing pressure in the indoor coil 195 psi, establishing a pressure difference of 160 psi.

The expansion device serving the indoor coil during summer cooling cycles is constructed and adjusted to meter liquid refrigerant to the indoor coil under condensing pressure in the outdoor coil of approximately 250 psi, while the evaporating pressure in the indoor coil would be in the range of 72 psi, establishing a pressure difference of 178 psi, at 85° F. ambient.

When a defrost cycle is initiated by establishing a temporary cooling cycle under the above conditions, the 35 psi condensing pressure in the outdoor coil is the maximum pressure available for introducing liquid refrigerant to the indoor coil through its high resistance expansion device adapted to controlling under a pressure difference in the range of 178 psi. The compressor is usually required to reduce the pressure in the indoor coil into a vacuum to produce the pressure differential necessary for feeding the indoor coil. The high resistance of the indoor expansion device, constructed to control refrigerant flow under a pressure differential in the range of 150 to 200 psi, offers excessive flow restriction under the defrosting cycle pressure differential in the range of 35 to 40 psi.

The sudden pressure drop from 35 psi condensing pressure requires the compressor to pump a vacuum that extracts, condenses, and delivers all the liquid refrigerant in the system into the outdoor coil. Coincidentally the refrigerant dissolved in the lubricating oil in the compressor crankcase expands into gas causing the oil to become foam having the consistency of whipped cream, which is also pumped into the outdoor coil. The liquid refrigerant and oil mixture is collected and retained in the outdoor coil during defrost cycles.

At the termination of each defrost cycle a heating cycle is started immediately by the change over of the reversing valve connecting the outdoor coil to the suction port of the compressor. Sudden delivery of the liquid and oil mixture from the outdoor coil to the compressor crankcase would be damaging to the compressor mechanism. Exposure to this damage is eliminated in contemporary heat pumps by a trap type accumulator installed between the reversing valve and the compressor suction port for collecting the inevitable surge of liquid refrigerant and oil mixture, and gradually releasing it into the compressor crankcase at a metered rate harmless to the compressor mechanism.

It is obvious that the trap type accumulator is an essential and effective device to protect the compressor in heat pump systems having the defrosting process described herein. Therefore compressor manufacturers, in their Engineering Bulletins for customer instruction, have made mandatory the use of trap type accumulators to protect their compressors and thereby reduce the number of compressor replacements under their warranties, as follows:

The Copeland Corporation, in its Engineering Bulletin No. AE-1243-R2, dated July 15, 1975, entitled "System Design for Air-to-Air Heat Pumps", includes the design requirements following:

"Unless the defrost cycle is such that liquid floodback does not occur, a suction accumulator is considered mandatory on all split systems, and on any system 3 horsepower and larger in size."

The Tecumseh Products Company, currently the world's largest manufacturer of compressors, in its Engineering Policy on Heat Pumps No. EP-4, revised Aug. 1, 1974, states:

"Consequently it is mandatory that a properly sized accumulator, of adequate oil return design, be used between the reversing valve and the compressor suction fitting. The accumulator should be sized to hold seventy-five percent of the system charge. A heat exchange (liquid to suction line) located between the accumulator and the compressor suction fitting is recommended to further help flood back to the compressor."

In view of the traditional heat pump design, and the compressor manufacturer's mandates for use of trap type accumulators, compressor engineers have followed the conventional design described herein and have accepted as inherent and unavoidable the detrimental effects of the accumulator on the defrosting process. This universal acceptance confirms the accumulator's advantages outweigh its principal disadvantages listed following:

1. It precludes the use of maximum heat from the indoor coil for defrosting by intercepting, cooling, and condensing hot gas from the indoor coil required for optimum defrosting in the shortest time.

2. It increases the time length of defrost cycles and thereby reduces the heat pump coefficient of performance.
3. It retains trapped liquid refrigerant during heating cycles, thus reducing residual liquid volume required in the indoor coil to accelerate the following defrost cycle with hot flash gas.
4. It limits minimum outdoor temperatures at which defrosting can be accomplished, thus requiring a cold weather lockout thermostat which precludes economical operation in cold climates. It imposes restart problems after cold weather lockout during abnormal cold weather in mild climates.
5. It precludes the use of air-to-air heat pumps as the universal replacement for combustion heating in all climates.

OBJECTS OF THE INVENTION

1. An accumulator connected in the refrigerant circuit of a conventional air-to-air heat pump so that it will control and meter liquid floodback from the outdoor coil harmless to the compressor during heating cycles, and will have no detrimental effect on defrosting cycles.
2. A refrigerant circuit bypassing the accumulator during defrosting cycles to provide direct flow of hot gas from the reversing valve to the outdoor coil to accelerate the defrosting process.
3. Check valves for providing single direction refrigerant flow from the outdoor coil through the accumulator to the reversing valve only only during heating cycles.
4. Check valve means providing single direction refrigerant flow from the reversing valve directly to the outdoor coil during defrost cycles, bypassing the accumulator, to accelerate defrosting with hot gas from the indoor coil by eliminating accumulator interception thereof.
5. To minimize the time length of defrost cycles.

BRIEF DESCRIPTION OF THE INVENTION

This invention achieves its heat pump improvement objectives through a relocation of the accumulator in the refrigerant circuit at a position different than in prior art as recorded since engineering adoption of the accumulator. In contemporary air-to-air heat pumps, as in the prior art, the accumulator is located between the reversing valve and the compressor suction port. FIG. 1 of the drawings shows this location of the accumulator, and refrigerant flow through the system circuit during heating cycles. FIG. 2 shows refrigerant flow during cooling and defrosting cycles. During defrosting hot refrigerant gas from the indoor coil flows first through the accumulator where it is reduced in volume by condensation, and simultaneously cooled, before delivery to the outdoor coil for frost removal.

FIG. 3 of the drawings shows the accumulator located between the reversing valve and the outdoor coil as specified in this invention. Refrigerant flow is indicated for heating cycles wherein two check valves control single direction refrigerant flow through the accumulator to protect the compressor from slugs of liquid refrigerant and oil from the outdoor coil during the beginning of heating cycles. FIG. 4 shows refrigerant flow during cooling and defrosting cycles. During defrosting hot refrigerant gas from the indoor coil is pumped by the compressor directly into the outdoor coil through a circuit bypassing the accumulator. This bypass includes a check valve controlling one way flow therethrough during defrosting cycles. The maximum amount of hot gas from the indoor coil is thus available for, and used for, defrosting the outdoor coil. The time length of defrosting cycles is thus substantially reduced from the time length of defrosting cycles in contemporary heat pumps. During defrosting cycles a check valve in the outlet tube of the accumulator is provided to prevent refrigerant flow through the accumulator.

DESCRIPTION OF TYPICAL EMBODIMENTS

Figure 1:
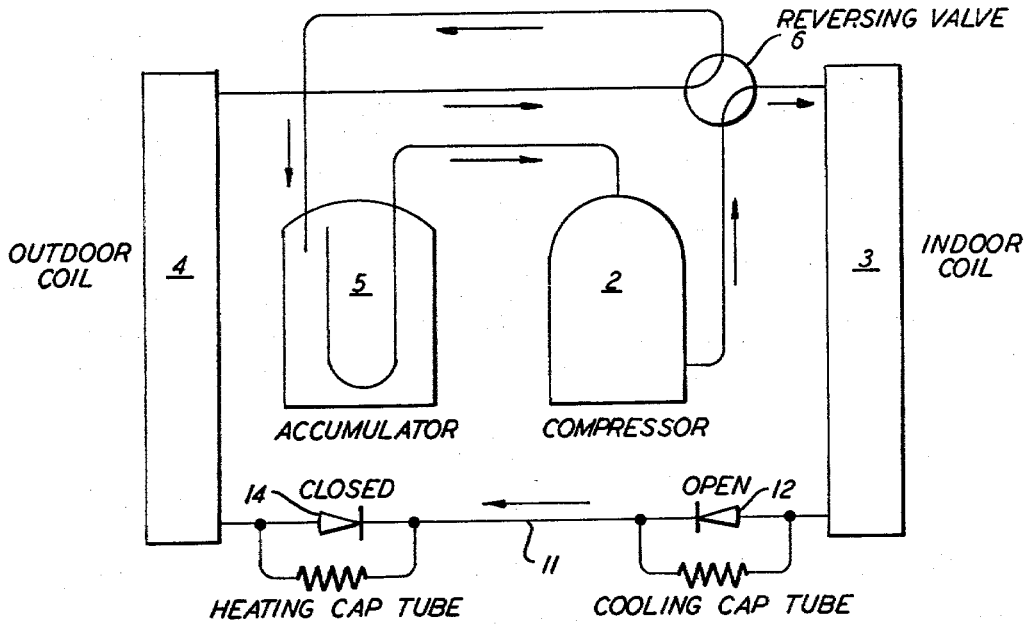
FIG. 1 Prior Art
FIG. 1 is a diagram of the contemporary and prior art basic design of the refrigerant circuit of air-to-air heat pumps embodying a trap type accumulator. Refrigerant flow direction is shown for heating cycles.
Figure 2:
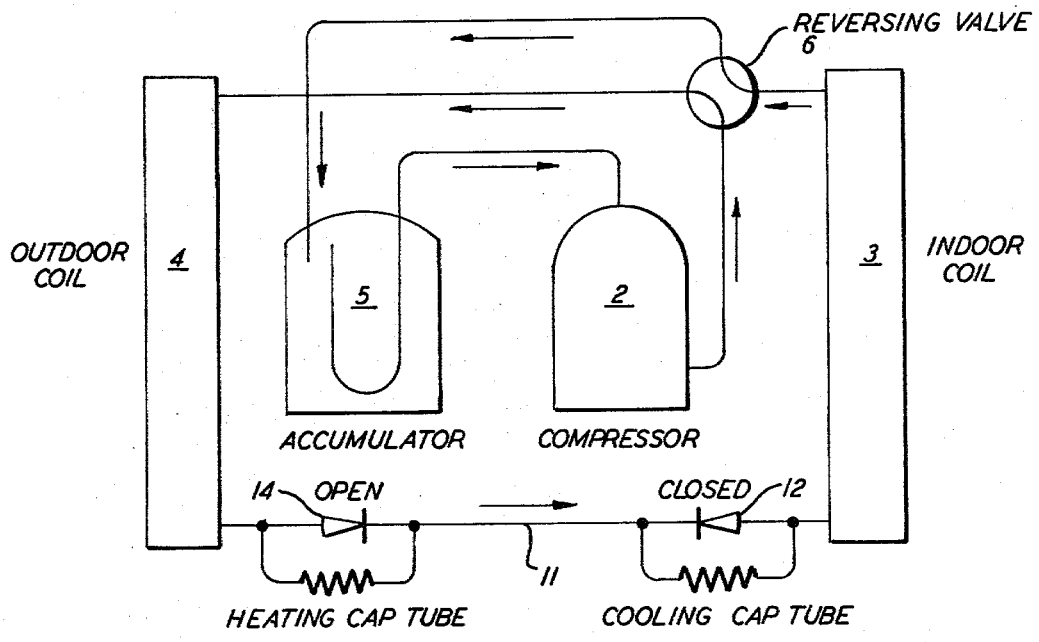
FIG. 2 Prior Art
FIG. 2 is the diagram of FIG. 1 wherein refrigerant flow direction in cooling and defrosting cycles is indicated.

Referring to FIGS. 1 and 2 there is shown a conventional air-to-air heat pump refrigerant circuit illustrated diagramatically in heating and cooling cycles. This circuit comprises compressor 2, indoor coil 3, outdoor coil 4, and accumulator 5 connected through reversing valve 6 adapted for responding to an indoor thermostat (not shown) for heating or cooling or to frost sensing device (not shown) for defrosting so that indoor coil 3 can be connected to the compressor either as an evaporator for cooling or defrosting, or as a condenser for heating, while outdoor coil 4 is connected as a reciprocal condenser or evaporator. While functioning as an evaporator indoor coil 3 is supplied with controlled refrigerant flow through capillary tube 7 from line 11, and outdoor coil 4 while functioning as an evaporator is also shown with a capillary tube for controlled refrigerant flow from line 11. The distinctive feature of this conventional heat pump circuit is the permanent connection of accumulator 5 downstream of the suction port of compressor 2 in both heating and cooling cycles. The principal disadvantages of locating the accumulator in the system circuit where it intercepts hot gas from the indoor coil to reduce its volume and temperature before delivering it to the outdoor coil for defrosting have been enumerated above.

Referring now to FIGS. 3, 4, 5 and 6 the improvements attained by this invention are illustrated diagramatically. The four diagrams show a heat pump refrigerant circuit comprising compressor 2, indoor coil 3, outdoor coil 4 and accumulator 5 connected through reversing valve 6 adapted for responding to an indoor thermostat (T, FIG. 3) for heating or cooling or to a frost sensing device (not shown) for defrosting so that indoor coil 3 can be connected to the compressor either as an evaporator for cooling or defrosting, or as a condenser for heating, while outdoor coil 4 is connected as a reciprocal condenser or evaporator. While functioning as an evaporator indoor coil 3 is supplied with controlled refrigerant flow through capillary tube 7, and outdoor coil 4 while functioning as an evaporator is supplied with controlled refrigerant flow through thermostatic expansion valve 8. Other types of expansion control devices may be used for either coil. FIGS. 3, 4, 5 and 6 are distinguished from the prior art by the provision of accumulator by-pass line 15, having check valve 16 therein, and from one another by the different locations in the system circuit of check valves 13, 19, and 21 arranged for controlling refrigerant flow in relation to accumulator 5. Each arrangement will be explained individually, following.

Figure 3:
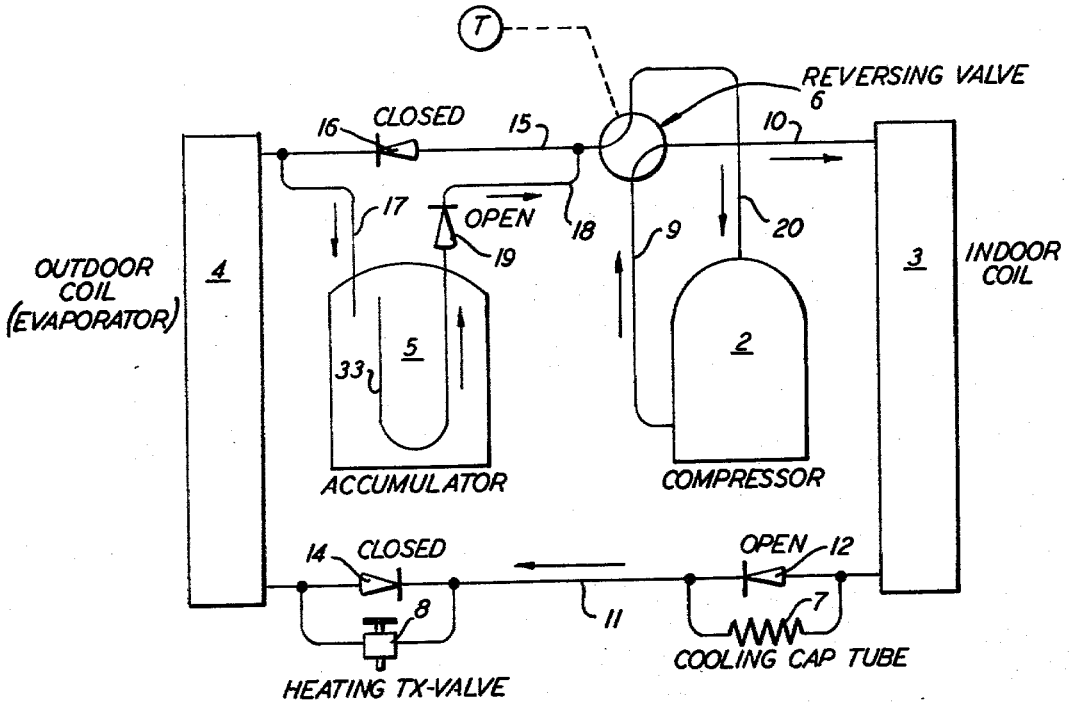
FIG. 3 is a diagram of a heat pump refrigerant circuit embodying this invention wherein a check valve in the accumulator outlet tube provides for fluid flow through the accumulator only during heating cycles. Refrigerant flow direction during heating cycles is indicated.

Referring to FIG. 3 refrigerant flow in a heating cycle is indicated by direction arrows. The reversing valve 6 directs the flow of the high pressure, high temperature, refrigerant gas from the discharge line 9 of compressor 2 through line 10 into the indoor coil 3 which then functions as a condenser to warm indoor air, and to condense refrigerant gas into a liquid. The liquid refrigerant then flows through line 11 including open check valve 12 to thermostatic expansion valve 8 from which it expands into outdoor coil 4 now functioning as an evaporator extracting heat from the outdoor air. Refrigerant gas then flows through line 17 into accumulator 5 where any entrained liquid is entrapped by U-tube 33 having its outlet opening within the top portion of the accumulator. Gas then flows from U-tube 33 through line 18 including open check valve 19, reversing valve 6, and through line 20 into the suction port of the compressor 2. Closed check valve 16 in the accumulator bypass line 15 prevents direct fluid flow from outdoor coil 4 through line 15, reversing valve 6 and line 20 into compressor 2 where the entrained volume of liquid refrigerant and compressor lubricating oil at the beginning of heating cycles would be harmful to the compressor. Thus the purpose and function of the accumulator is accomplished.

Figure 4:
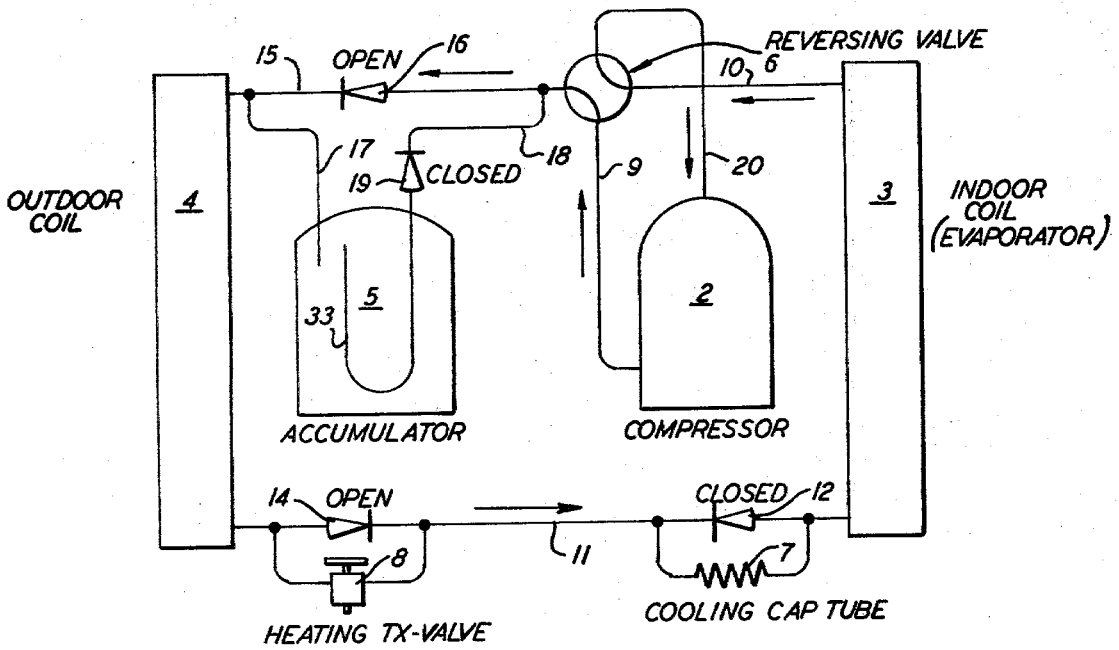
FIG. 4 is the diagram of FIG. 3 wherein refrigerant flow direction is indicated for cooling and defrost cycles.

Referring to FIG. 4 refrigerant flow in a cooling or defrost cycle is indicated by direction arrows. When a frost sensing device (not shown) calls for defrosting outdoor coil 4 it initiates a defrost cycle by causing reversing valve 6 to change over to a defrost cycle wherein it directs the flow of high pressure, high temperature, refrigerant gas from the discharge line 9 of the compressor 2 through line 15 including open check valve 16 directly into outdoor coil 4. The circuit through accumulator 5 comprises accumulator inlet line 17, U-tube 33, and outlet line 18 including closed check valve 19. This circuit is parallel to line 15 and is closed by check valve 19 during defrosting cycles so that hot gas from compressor 2 flowing through discharge line 9 and reversing valve 6 cannot be intercepted by accumulator 5 to reduce the amount of hot gas available from indoor coil 3 for defrosting the outdoor coil 4.

Figure 5:
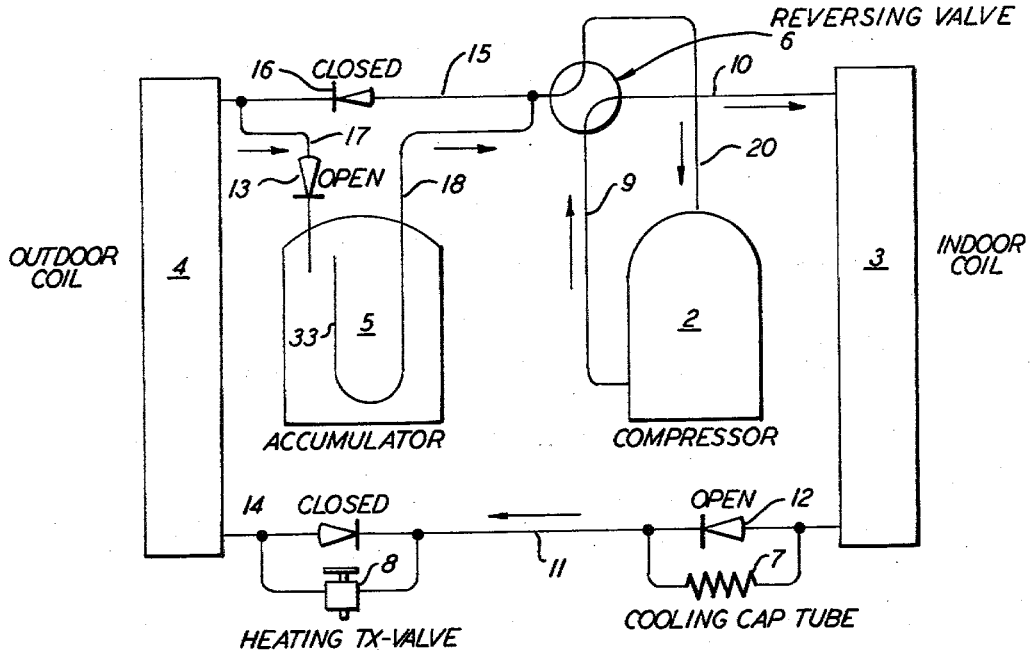
FIG. 5 is a diagram similar to FIG. 3, but showing an accumulator check valve in its inlet tube instead of in its outlet tube, to provide for fluid flow through the accumulator only during heating cycles.

Referring to FIG. 5 refrigerant flow in a heating cycle is indicated by direction arrows the same as in FIG. 3. The two diagrams are identical except for the location of the open accumulator check valve 13 included in the accumulator inlet line 17 in FIG. 5. This is an alternate to the open check valve 19 in accumulator outlet line 18 of FIG. 3. In their respective locations check valves 13 and 19 are open during heating cycles so that liquid entrained in gas flow will be entrapped in accumulator 5 during heating cycles. In both diagrams the closed check valve 16 is shown in line 15 to prevent direct fluid flow from outdoor coil 4 through reversing valve 6 and suction line 20 into compressor 2 during heating cycles.

Figure 6:
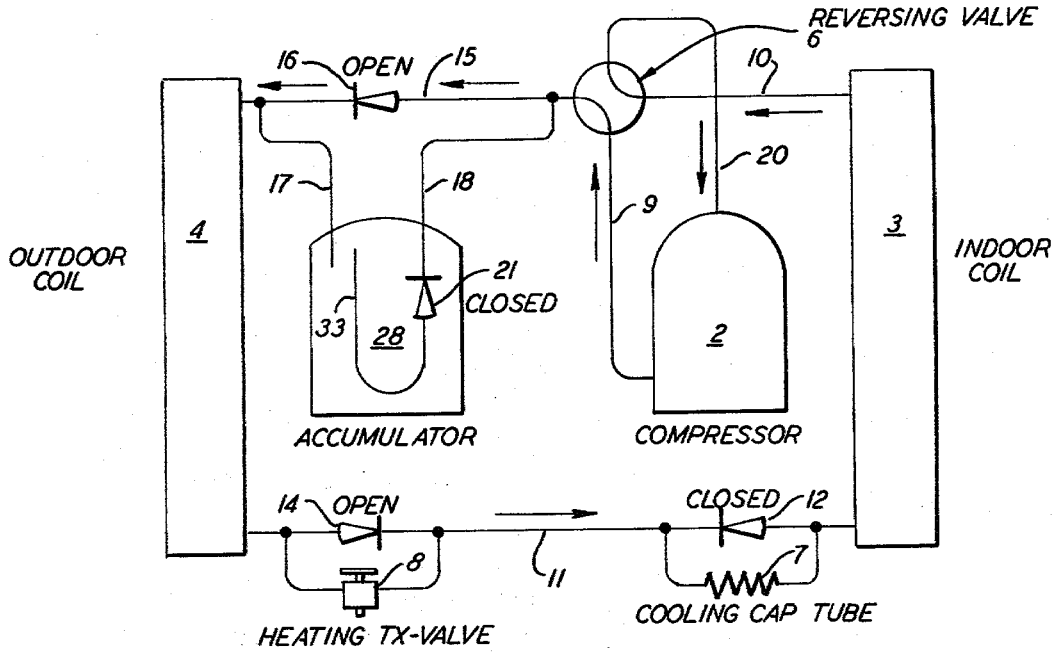
FIG. 6 is a diagram similar to FIG. 4, but showing the accumulator check valve inside the accumulator in its U-tube, instead of in its external outlet tube.

Referring to FIG. 6 refrigerant flow in a cooling or defrosting cycle is indicated by direction arrows the same as in FIG. 4. The two diagrams are identical except for the location of the closed accumulator check valve 21 inside the accumulator in its U-tube 33. This is an alternate to the closed check valve 19 included in accumulator outlet line 18 of FIG. 4. In their respective locations check valves 19 and 21 are closed during defrosting cycles so that hot gas from compressor 2 delivered through discharge line 9, reversing valve 6, and line 15 to outdoor coil 4 cannot be intercepted by accumulator 5 to reduce the amount and temperature of hot gas available from indoor coil 3 for defrosting outdoor coil 4.

Figure 7:
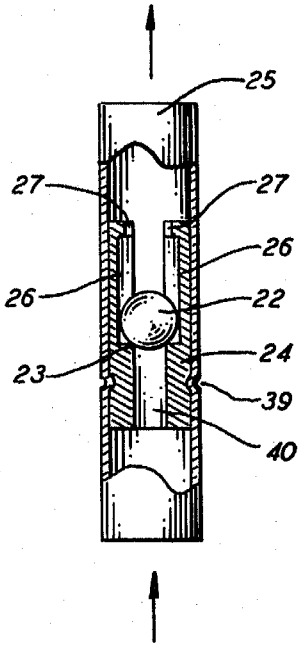
FIG. 7 is a cross-sectional view of a ball type check valve adapted to the accumulator outlet tube in heat pump refrigerant circuits embodying this invention. It is shown in a vertical position with the ball seated by gravity to prevent downward flow therethrough.

Referring to FIG. 7 a widely used ball type check valve is shown with its body tube 25 enclosing ball seat cylinder 24 in a pressure tight fit secured by its annular groove 39 depressed into a mating annular groove in cylinder 24. Axial hole 40 through cylinder 24 has annular ball seat 23 at one end to support ball 22 in its closed position. Two legs 26 integral with cylinder 24 extend longitudinally from its ball seat end to provide a race for ball 22. A lug extends radially inward from the outer end of each leg 26 to provide a stop for the ball in its open position. This type check valve fulfills the requirements of heat pump refrigerant circuits embodying this invention and is shown in the drawings as Nos. 12, 13, 14, 19 and 21.

Figure 8:
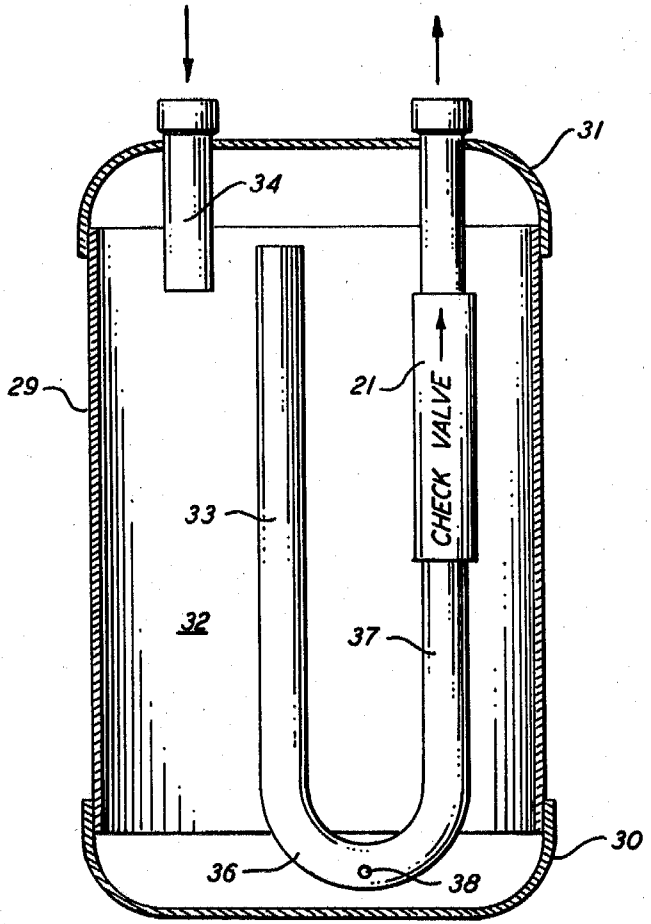
FIG. 8 is a cross-section view of a trap type accumulator with a check valve added in its U-tube 33 as shown in FIG. 6.

Referring to FIG. 8 a cross-sectional view of a conventional trap type accumulator is shown adapted to this invention by the inclusion of check valve 21 in its U-tube 33. A cylindrical housing 29 is provided with base cap 30 and top cover 31. Inlet tube 34 extends a short way into trap chamber 32 to a point below the elevation of the open end of the inlet leg of U-tube 33. Outlet leg 37 of the U-tube includes check valve 21 providing for one way refrigerant flow outward from trap chamber 32 through cover 31. The U-tube bend 36 at the bottom portion of chamber 32 is provided with hole 38 sized for metering liquid entrapped in chamber 31 into the refrigerant gas flow through U-tube 33 and into the system refrigerant circuit at a rate harmless for ingestion by the compressor when operating in a heating cycle.

It will be apparent to those skilled in the art that this invention offers opportunity for construction of heat pumps having increased heating efficiency through a marked reduction of time required to complete the defrosting process.

What is claimed is:

1. An air-to-air heat pump for operation in both heating and cooling cycles comprising:

(a) indoor and outdoor air coils connected by a first line for flow of refrigerant therebetween;

(b) first valve means for controlling the direction of flow through said first line from said indoor to said outdoor coil during heating cycles and from said outdoor to said indoor coil during cooling cycles;

(c) a refrigerant compressor;

(d) a trap-type accumulator for preventing flow of liquid refrigerant and oil into said compressor during heating cycles;

(e) a selectively adjustable, indoor thermostat; and (f) second valve means operable in response to said thermostat to connect said outdoor coil through a second line to said accumulator and thence to said compressor and said indoor coil during heating cycles, and to connect said indoor coil for refreigerant flow to said compressor and thence through a third line directly to said outdoor coil, bypassing said accumulator, during cooling cycles.

2. The invention according to claim 1 wherein said first valve means comprises a pair of one-way check valves, each having a by-pass line.

3. The invention according to claim 1 wherein said second valve means comprises a reversing valve and a one-way check valve, the latter arranged in said third line.

4. The invention according to claim 1 and further including a check valve in said second line for one-way flow of refrigerant through said accumulator.

5. The invention according to claim 4 wherein said check valve is arranged in said second line in advance of said accumulator.

6. The invention according to claim 4 wherein said check valve is arranged in said second line after said accumulator.

7. The invention according to claim 4 wherein said accumulator includes a U-tube trap and said check valve is arranged in said trap.

8. The invention according to claims 4, 5, 6 or 7 wherein said check valve is a ball-type constructed and oriented so that gravity assists in seating the ball to prevent flow therethrough during cooling cycles.

9. The invention according to claim 1 wherein said first valve means includes first and second, oppositely directed, one-way check valves each having a by-pass line, said second valve means includes a reversing valve and a third one-way check valve, the latter arranged in said third line, and further including a fourth one-way check valve in said second line for one-way flow of refrigerant through said accumulator.

* * * * *